US007682070B2

(12) United States Patent
Burton

(10) Patent No.: US 7,682,070 B2
(45) Date of Patent: Mar. 23, 2010

(54) TIMEPIECE WITH STABILIZING BEZEL

(75) Inventor: Maximillian P. Burton, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/848,408

(22) Filed: Aug. 31, 2007

(65) Prior Publication Data

US 2009/0059734 A1 Mar. 5, 2009

(51) Int. Cl.
*G04B 39/00* (2006.01)

(52) U.S. Cl. ..... 368/294; 368/88

(58) Field of Classification Search ..... 368/88, 368/294–295

See application file for complete search history.

(56) References Cited

U.S. PATENT DOCUMENTS 3,492,809 A * 2/1970 Gisiger-Lusa ..... 368/282
3,688,492 A * 9/1972 Yabana ..... 368/291
4,023,347 A * 5/1977 Haber ..... 368/282
4,178,751 A * 12/1979 Liautaud ..... 368/281
4,229,936 A * 10/1980 Schneider et al. ..... 368/282
4,993,007 A * 2/1991 Meister ..... 368/294
5,065,376 A * 11/1991 Choulat ..... 368/282
5,490,123 A 2/1996 Biver
6,357,908 B1 * 3/2002 Hunziker ..... 368/287
6,857,775 B1 2/2005 Wilson
6,863,436 B2 3/2005 Kaelin
7,114,845 B2 10/2006 Wilson

* cited by examiner

*Primary Examiner*—Renee S Iuebke
*Assistant Examiner*—Sean Kayes
(74) *Attorney, Agent, or Firm*—Plumsea Law Group, LLC

(57) ABSTRACT

A wrist-worn timepiece may have a case, a timing element, and a wristband. The case includes a body, a crystal, and a bezel. The body may define a depression and a channel. The timing element is positioned within the depression, and the channel is located to extend at least partially around the depression. The crystal is located within the depression and adjacent to the timing element, and the bezel is at least partially located within the channel. The body may be formed from a polymer material and the bezel may be formed from a metal material.

8 Claims, 12 Drawing Sheets

TIMEPIECE WITH STABILIZING BEZEL

BACKGROUND

A conventional wrist-worn timepiece (i.e., a watch) may be structured to perform both aesthetically and functionally during a variety of activities. Dress watches, for example, are designed to have a fashionable appearance appropriate for business or social gatherings. Diving watches are designed to be particularly durable and water-resistant in order to withstand the high-pressure environments often encountered by scuba divers. In addition, sport watches are designed to be lightweight and worn by athletes during athletic training or competitions.

The components of a conventional watch generally include a timing element, a wristband, and a case. The timing element is located within the case and primarily functions to display time in either an analog or digital format. The wristband extends from opposite sides of the case and secures the case and timing element to a wrist of an individual. The case protects the timing element and often includes a transparent crystal for viewing the time or other information displayed on the timing element.

Although a majority of watches include a timing element, case, and wristband, modern watch designs include many variations upon these components. For example, the timing element may incorporate mechanical, electrical, or a combination of mechanical and electrical components. In addition to displaying time, the timing element may function as a chronograph, count-down timer, alarm, lap counter, calculator, thermometer, heart-rate monitor, altimeter, or global positioning system device, for example. Materials forming the case may be a polymer or a metal, and the crystal may be formed from a polymer, glass, or sapphire crystal, for example. Furthermore, the wristband may be formed from a metal, a polymer, or leather, and the wristband may have a clasp that secures the watch to the wrist or an open, bracelet-type configuration.

SUMMARY

A wrist-worn timepiece may have a case, a timing element, and a wristband. The case includes a body, a crystal, and a bezel. The body defines a depression and a channel. The timing element is positioned within the depression, and the channel is located to extend at least partially around the depression. The crystal is located within the depression and adjacent to the timing element, and the bezel is at least partially located within the channel. In order to impart stability to the case, the bezel may be formed from a metal material.

A method for manufacturing a wrist-worn timepiece may include defining a depression and a channel in a polymer material and also placing a timing element within the depression. A metal bezel may be positioned within the channel and around the depression. Also, a crystal may be located within the depression and adjacent to the timing element after positioning the bezel within the channel.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
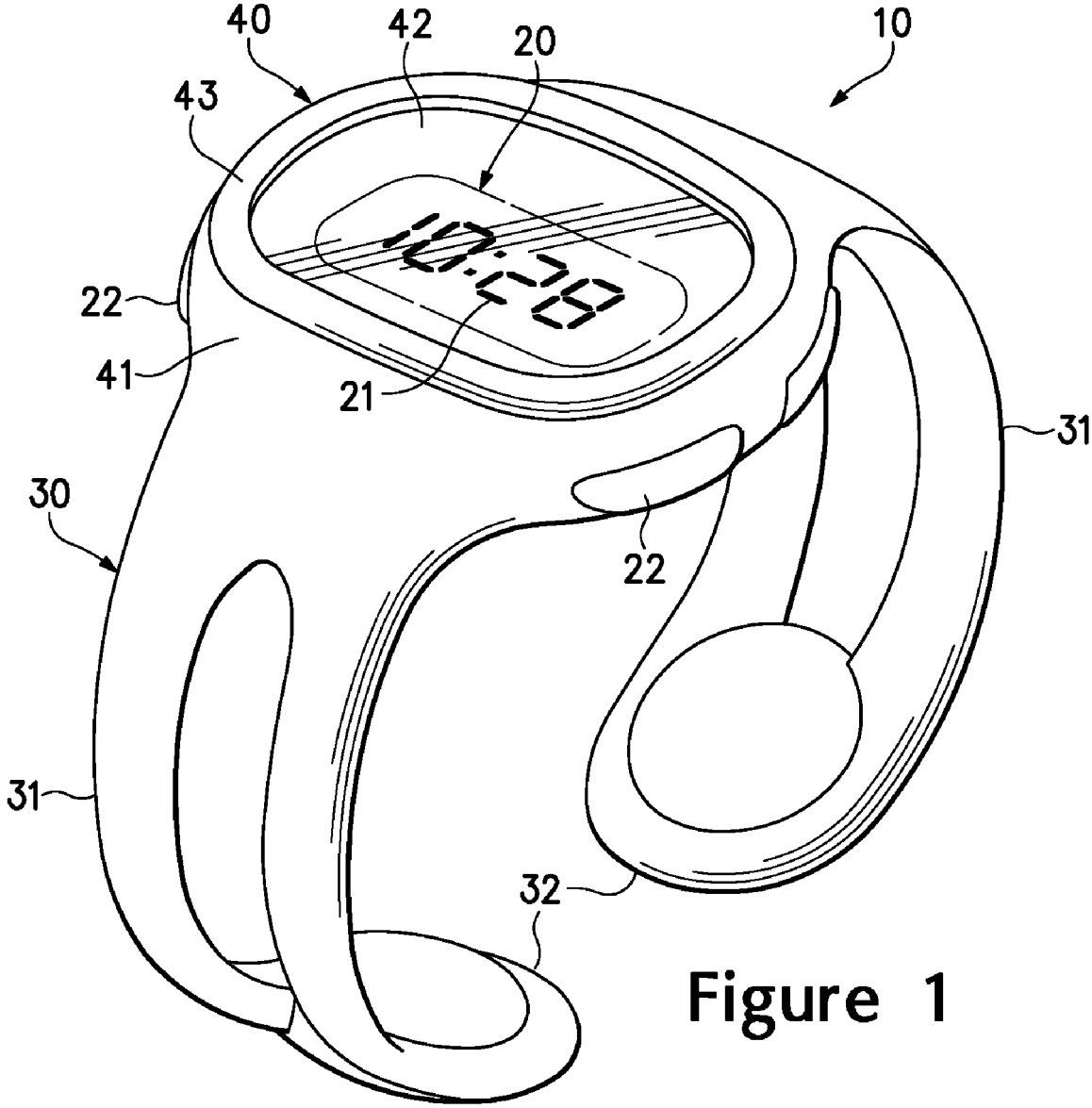
FIG. 1 is a perspective view of a wrist-worn timepiece.
Figure 2:
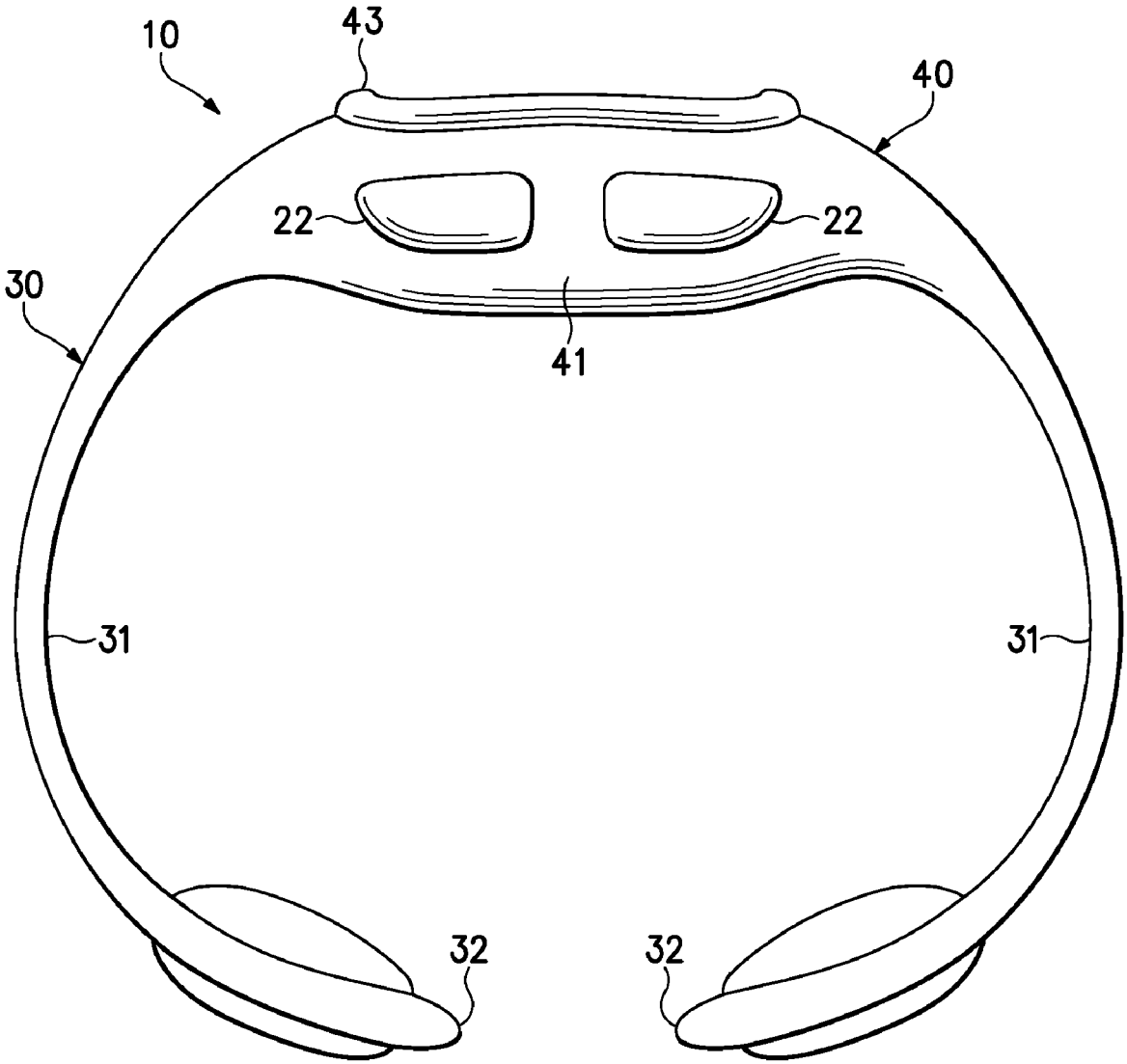
FIG. 2 is a side elevational view of the timepiece.
Figure 3:
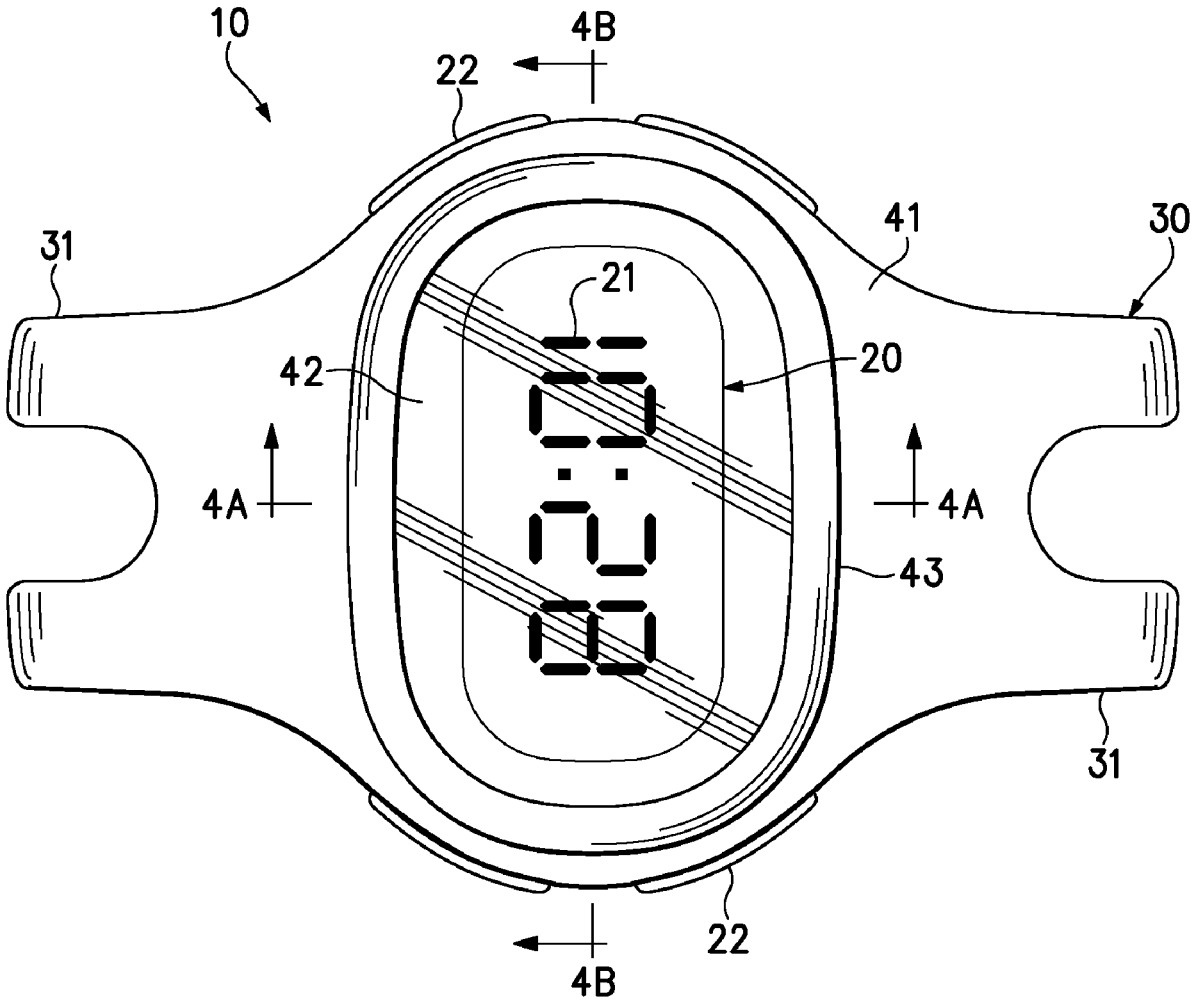
FIG. 3 is a top plan view of the timepiece.
Figure 4A:
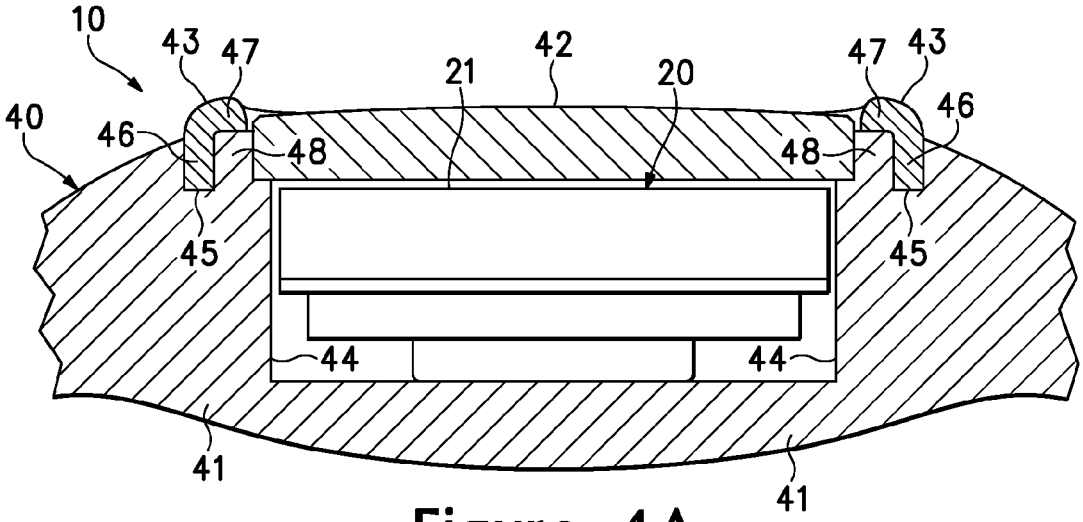
FIGS. 4A and 4B are cross-sectional views of the timepiece, as defined by section lines 4A and 4B in FIG. 3.
Figure 4B:
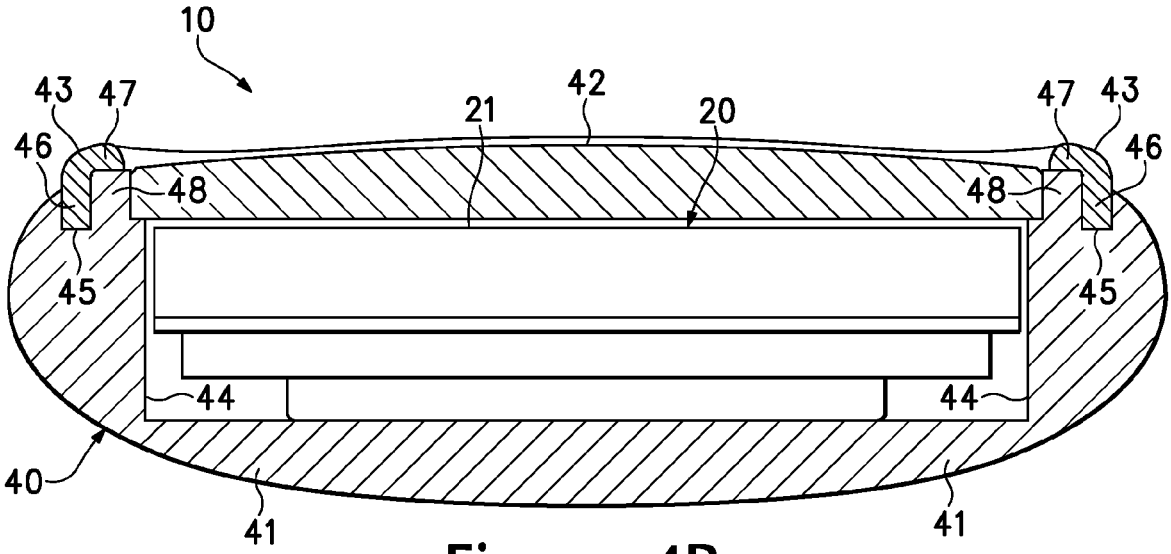

The following discussion and accompanying figures disclose a wrist-worn timepiece 10 (i.e., a watch) with a stabilizing bezel configuration. Timepiece 10 is depicted as having a configuration of a sport watch that is suitable for use during athletic training sessions or various athletic competitions. Concepts associated with timepiece 10 are not limited to timepieces with the configurations of sport watches, however, and may be incorporated into a variety of dress watches, diving watches, and causal watches, for example. Accordingly, the various concepts disclosed with regard to timepiece 10 apply to a wide variety of watch styles.

Timepiece Configuration

Referring to FIGS. 1-5, the primary elements of timepiece 10 are a timing element 20, a wristband 30, and a case 40. Timing element 20 is located within case 40 and includes a display 21 that visually displays the time or other information. Although display 21 is depicted as having a digital configuration, display 21 may also have an analog configuration depending upon whether timing element 20 incorporates electrical, mechanical, or a combination of mechanical and electrical components. In addition to tracking the time and displaying the time on display 21, timing element 20 may function as a chronograph, count-down timer, alarm, lap counter, calculator, thermometer, heart-rate monitor, altimeter, or global positioning system device, for example. In order to adjust the time and utilize these functions, timing element 20 includes various depressible buttons 22 that extend outward from case 40. Accordingly, the configuration of timing element 20 and the functions that timing element 20 imparts to timepiece 10 may vary significantly.

Wristband 30 is utilized to secure timepiece 10 to a wrist of a wearer and has an open, bracelet-type configuration. More particularly, wristband 30 includes two extensions 31 that extend outward from opposite sides of case 40 to wrap around opposite sides of the wrist. Although extensions 31 are depicted as being formed of unitary (i.e., one piece) construction with a portion of case 40, extensions 31 may be formed separately and joined with case 40 in some configurations of timepiece 10. Extensions 31 each have an end 32 that is positioned opposite case 40 and defines a space or gap in wristband 30. When placing timepiece 10 upon the wrist or removing timepiece 10 from the wrist, extensions 31 may be flexed outward to increase the space between ends 32 and permit the wrist to pass between the space or gap defined by ends 32. A timepiece having a similar bracelet-type configuration is disclosed in U.S. Pat. Nos. 6,857,775 and 7,114,845 to Wilson. In addition to the open, bracelet-type configuration, wristband 30 may have a more traditional configuration formed from a metal material (e.g., links), a polymer material, or leather and including a clasp that secures timepiece 10 to the wrist. Accordingly, the configuration of wristband 30 may vary significantly.

Although a variety of materials may be utilized for wristband 30, a plurality of polymer materials may be sufficiently rigid to hold timepiece 10 upon the wrist and sufficiently flexible to permit extensions 31 to flex outward when placing timepiece 10 upon the wrist or removing timepiece 10 from the wrist. Suitable polymer materials for wristband 30 include acrylic, nylon, polycarbonate, polyethylene, polystyrene, polyurethane, polyester, a polyester-polycarbonate blend, and rubber, for example. In addition to polymer materials, wristband 30 may be formed from a variety of metal materials, including steel, aluminum, titanium, brass, silver, or gold. Combination of polymer and metal materials may also be utilized.

Case 40 provides a protective housing for timing element 20, thereby shielding timing element 20 from external forces and substantially preventing water or other liquids from interfering with the operation of timing element 20. The primary elements of case 40 are a body 41, a crystal 42, and a bezel 43. Body 41 forms a majority of case 40 and defines a depression 44 that receives timing element 20 and crystal 42. In addition, body 41 defines a channel 45 that receives bezel 43. Although body 41 is depicted as having a generally rounded and elliptical shape, body 41 may also exhibit a circular, square, rectangular, trapezoidal, hexagonal, or variety of other geometric or non-geometric shapes. As discussed in greater detail below, body 41 or portions of body 41 may be formed from a variety of polymer materials and metal materials, including any of the polymer materials and the metal materials discussed above in relation to wristband 30.

Crystal 42 has an at least partially transparent configuration that provides visual access to display 21 of timing element 20. That is, display 21 may be viewed through crystal 42. As noted above, depression 44 receives timing element 20 and crystal 42. When timepiece 10 is assembled, timing element 20 and crystal 42 are adjacent to each other and may be in contact with each other. More particularly, an upper surface of timing element 20 is adjacent to a lower surface of crystal 42, as depicted in each of FIGS. 4A and 4B. In some configurations, a space may be formed between timing element 20 and crystal 42. Although crystal 42 is referred to herein as a "crystal", crystal 42 may be formed from a variety of at least partially transparent materials, including polymers, glass, and sapphire crystal, for example. Accordingly, crystal 42 may be formed from a variety of materials, in addition to crystal.

Figure 5:
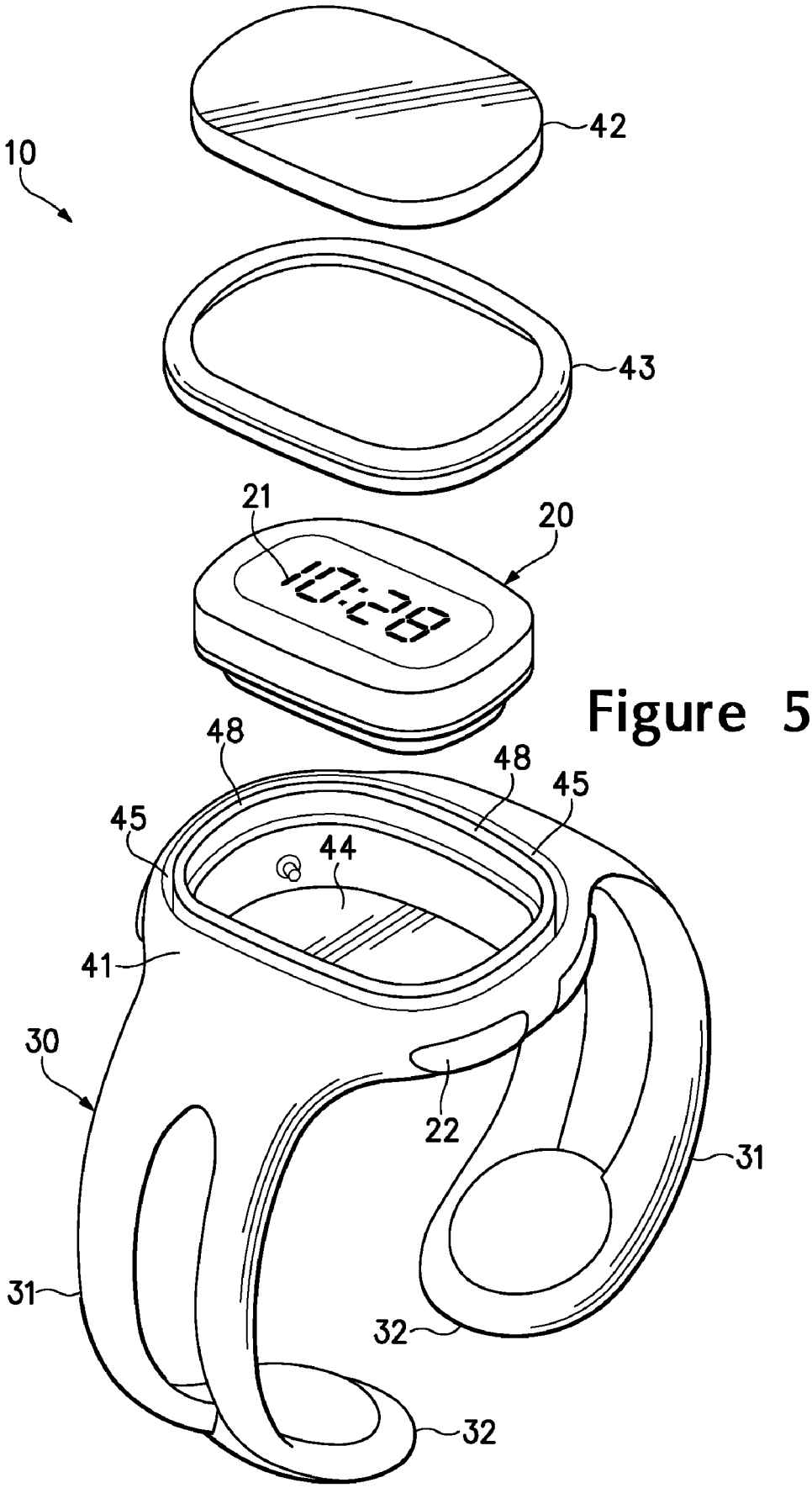
FIG. 5 is an exploded perspective view of the timepiece.

Depression 44 extends downward and into a central area of an upper surface of body 41 (i.e., a surface facing away from the wrist). Depression 44 has a configuration that generally corresponds with a shape of timing element 20 and crystal 42. Referring to FIG. 5, for example, a lower area of depression 44 is depicted as having a shape and size of timing element 20, whereas an upper area of depression 44 is depicted as having a shape and size of crystal 42. That is, edges of each of timing element 20 and crystal 42 may contact and abut the surfaces of depression 44 when timepiece 10 is assembled.

As with depression 44, channel 45 extends downward and into the upper surface of body 41, but channel 45 may extend to a lesser depth than depression 44. Whereas depression 44 is located in a central area of the upper surface, channel 45 extends around depression 44 and is located in a more peripheral area of the upper surface. As noted above, channel 45 receives bezel 43. Referring to the FIGS. 4A and 4B, bezel 43 is depicted as having an L-shaped configuration that includes a first segment 46 and a second segment 47. First segment 46 extends downward and into channel 45, and second segment 47 extends toward crystal 42 and is adjacent to an edge of crystal 42. In addition to extending around depression 44, channel 45 may also be spaced from depression 44. In this configuration, also depicted in FIGS. 4A and 4B, a portion 48 of body 41 extends upward to separate depression 44 from channel 45. That is, portion 48 extends between crystal 42 and first segment 46, and second segment 47 extends over and covers portion 48. In some configurations, portion 48 may be absent such that crystal 42 contacts first segment 47.

Bezel 43 has the configuration of a ring that extends around crystal 42 and depression 44. In addition to providing protection to an edge of crystal 42 and enhancing the overall aesthetic aspects of timepiece 10, bezel 43 may provide stability to case 40. As discussed in greater detail below, body 41 may be formed from a polymer material and bezel 43 may be formed from a metal material. When crystal 42 is formed from a relatively rigid material and inserted into depression 44, the edges of crystal 42 may contact and press outward upon the surfaces of depression 44, which may tend to warp or bend the relatively deformable material forming body 41. The presence of bezel 43, which gains stability by being formed from a less deformable material and having an L-shaped configuration, may limit or otherwise counteract the tendency of body 41 to warp or bend when crystal 42 is inserted. Furthermore, the relatively stable bezel 43 may limit the degree to which case 40 warps or bends during the use of timepiece 10. For example, bezel 43 may limit bending in body 41 when extensions 31 are flexed outward to place timepiece 10 upon the wrist, thereby preventing crystal 42 from falling out or otherwise exiting depression 44. That is, bezel 43 may ensure that crystal 42 remains properly positioned within depression 44 during the use of timepiece 10. Although bezel 43 is depicted as extending entirely around crystal 42 and depression 44, bezel 43 may have a configuration that extends only partially around crystal 42 and depression 44 in some configurations of timepiece 10.

Based upon the above discussion, bezel 43 may provide stability to body 41 when crystal 42 is inserted into depression 44 and when placing timepiece 10 upon the wrist. More particularly, when body 41 is formed of a relatively deformable material (i.e., a polymer material) and bezel 43 is formed from a relatively stable material (i.e., a metal material), then bezel 43 may prevent forces exerted by crystal 42 from warping or bending body 41. Another factor that may be relevant to the warping or bending of body 41 is the relative deformability of crystal 42. That is, when crystal 42 is formed from a relatively deformable material, then crystal 42 may be less likely to warp or bend body 41 when inserted into depression 44. Conversely, when crystal 42 is formed from a relatively stable material, then crystal 42 may be more likely to warp or bend body 41 when inserted into depression 44. Accordingly, the relative deformability of each of body 41, crystal 42, and bezel 43 may be considered in designing timepiece 10.

Elastic Modulus of Timepiece Materials

In determining the relative deformability of body 41, crystal 42, and bezel 43, the elastic modulus of the materials forming body 41, crystal 42, and bezel 43 may be considered. Also referred to as the modulus of elasticity and Young's modulus, the elastic modulus is the mathematical description of an object or substance's tendency to be deformed elastically (i.e. non-permanently) when a force is applied to it. More particularly, the elastic modulus is defined as the slope of the stress-strain curve of a material in the elastic deformation region. In general, less force is necessary to stretch, compress, and bend a material with a relatively low elastic modulus, and greater force is necessary to stretch, compress, and bend a material with a relatively high elastic modulus.

Many polymer materials that are suitable for body 41 have an elastic modulus in a range of 1 to 4 gigapascals. For example, acrylic has an elastic modulus of approximately 3.2 gigapascals, nylon has an elastic modulus of approximately 1.6 to 3.4 gigapascals, polycarbonate has an elastic modulus of approximately 2.6 gigapascals, high density polyethylene has an elastic modulus of approximately 0.8 gigapascals, and polystyrene has an elastic modulus of approximately 3 to 3.5 gigapascals. When formed from a polymer material, crystal 42 may also have an elastic modulus in a range of 1 to 4 gigapascals. Another suitable material for crystal 42 is glass, which has an elastic modulus of approximately 50 to 90 gigapascals. As a further comparison, many metal materials that are suitable for bezel 43 have an elastic modulus in a range of 45 to 210 gigapascals. For example, steel has an elastic modulus of approximately 210 gigapascals, aluminum has an elastic modulus of approximately 69 gigapascals, titanium has an elastic modulus of approximately 110 gigapascals, brass has an elastic modulus of approximately 100 to 125 gigapascals, silver has an elastic modulus of approximately 72 gigapascals, and gold has an elastic modulus of approximately 74 gigapascals. Based upon the various example elastic modulus values presented above, therefore, the elastic modulus of glass that is suitable for crystal 42 may be 12 times the elastic modulus of the polymer materials forming body 41, and the elastic modulus of metals that are suitable for bezel 43 may be at least 40 to 200 times the elastic modulus of polymer materials forming body 41.

Although the specific materials utilized in each of the elements of case 40 may vary significantly, forming bezel 43 from a material with an elastic modulus at least 40 times the elastic modulus of the material forming body 41 generally provides sufficient stability to case 40. That is, crystal 42 will be less likely to warp or bend body 41 when inserted into depression 44 if the material forming bezel 43 has an elastic modulus at least 40 times the elastic modulus of the material forming body 41. Even when, for example, crystal 42 is formed from a material with 12 times or more of the elastic modulus of the polymer materials forming body 41 (i.e., glass or crystal), forming bezel 43 from a material with an elastic modulus at least 40 times the elastic modulus of the material forming body 41 generally provides sufficient stability to case 40. In some configurations of timepiece 10, however, bezel 43 may be formed from a material with an elastic modulus that is less then 40 times (i.e., 5 times, 10 times, 15 times, 20 times) the elastic modulus of the material forming body 41.

Timepiece Assembly

Figure 6A:
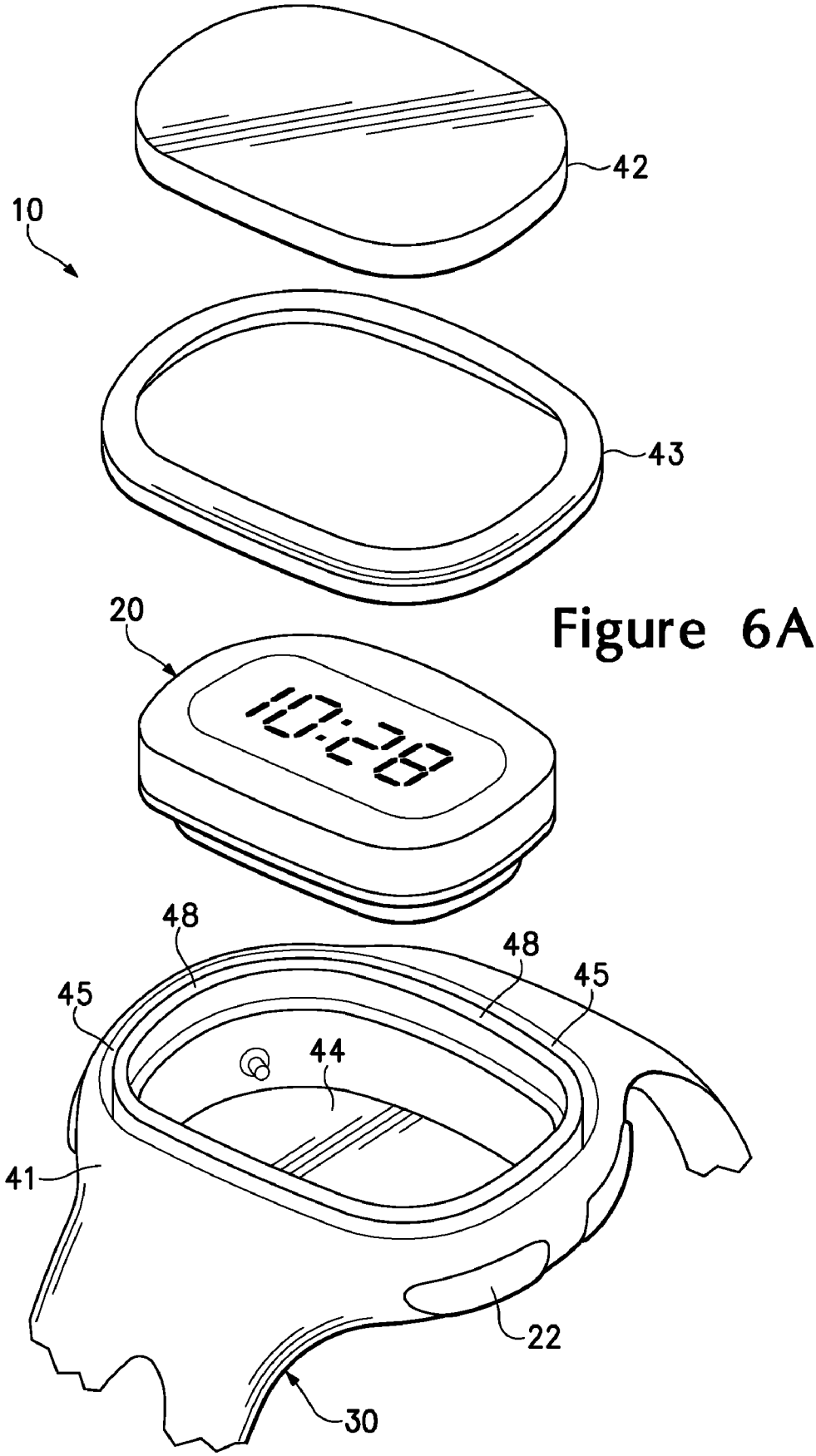
FIGS. 6A-6C are perspective views depicting a procedure for assembling a case of the timepiece.
Figure 6B:
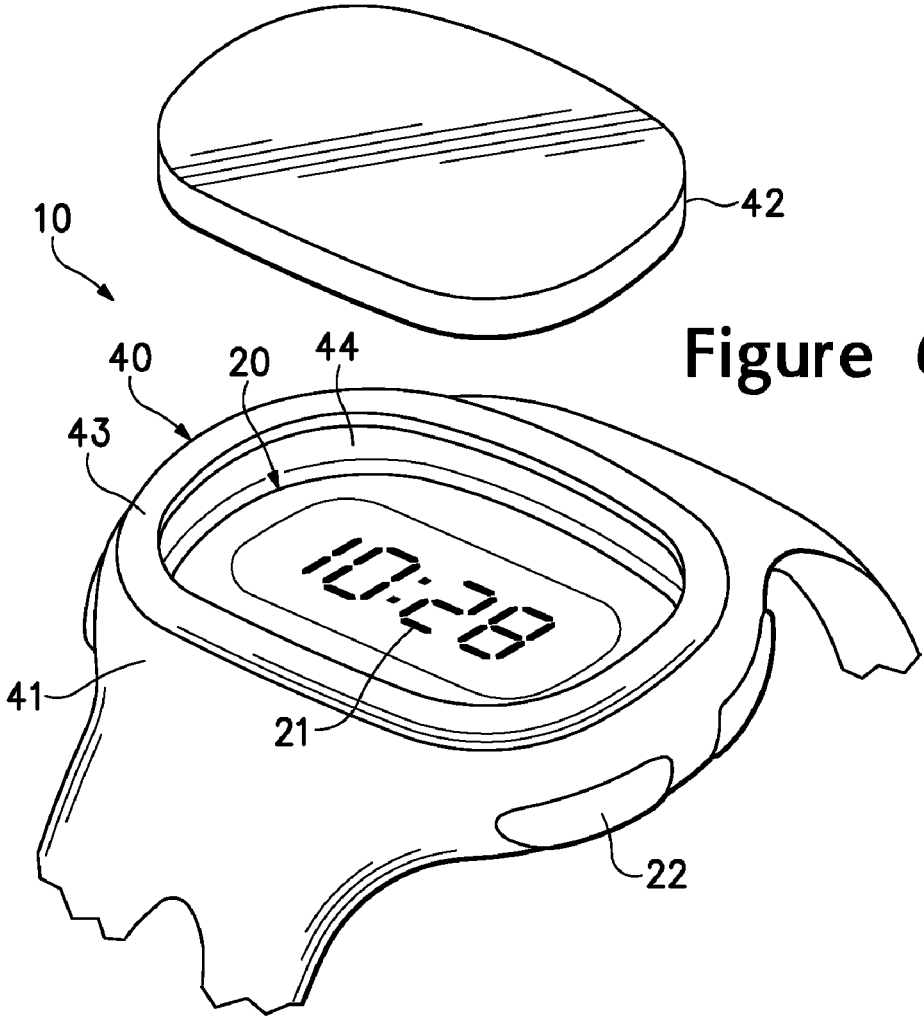
Figure 6C:
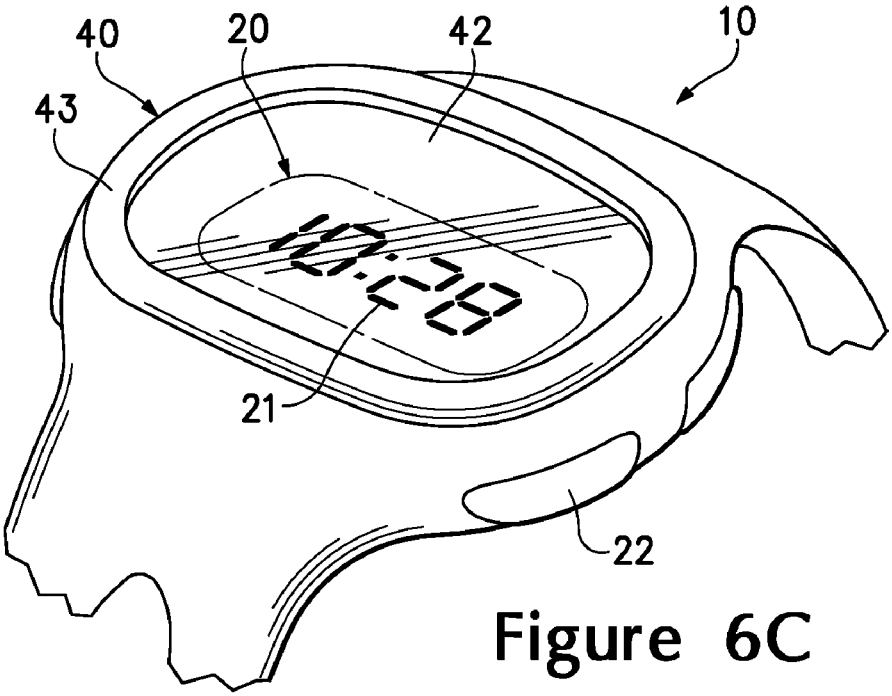

Although a variety of procedures may be utilized to assemble case 40, some methods may be less likely to warp or bend body 41 when crystal 42 is inserted. Referring to FIG. 6A, the various elements of case 40 are depicted in an unassembled state. Initially, timing element 20 may be placed within depression 44 and bezel 43 may be positioned within channel 45, as depicted in FIG. 6B. Once timing element 20 and bezel 43 are properly positioned with respect to body 41, crystal 42 may be located within depression 44, as depicted in FIG. 6C. As discussed above, the edges of crystal 42 may contact and press outward upon the surfaces of depression 44, which may tend to warp or bend the relatively deformable material forming body 41. By positioning bezel 43 within channel 45 prior to locating crystal 42 within depression 44, bezel 43 is present to limit or prevent the warping or bending when crystal 42 is installed. That is, positioning bezel 43 within channel 45 prior to locating crystal 42 within depression 44 serves to stabilize case 40 and prevents the warping or bending of body 41 that may otherwise occur.

Further Timepiece Configurations

Figure 7A:
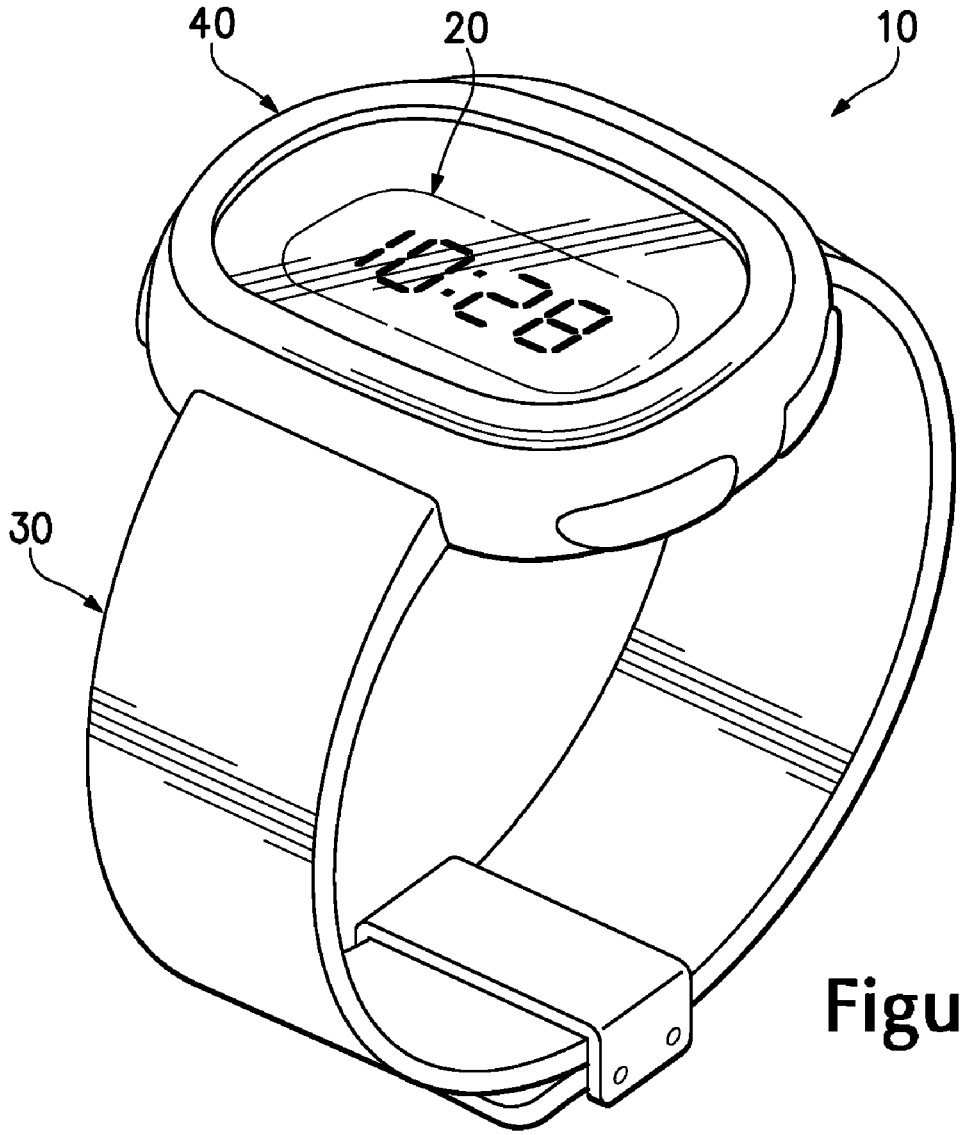
FIGS. 7A-7D are perspective views corresponding with FIG. 1 and depicting additional configurations of the timepiece.
Figure 7B:
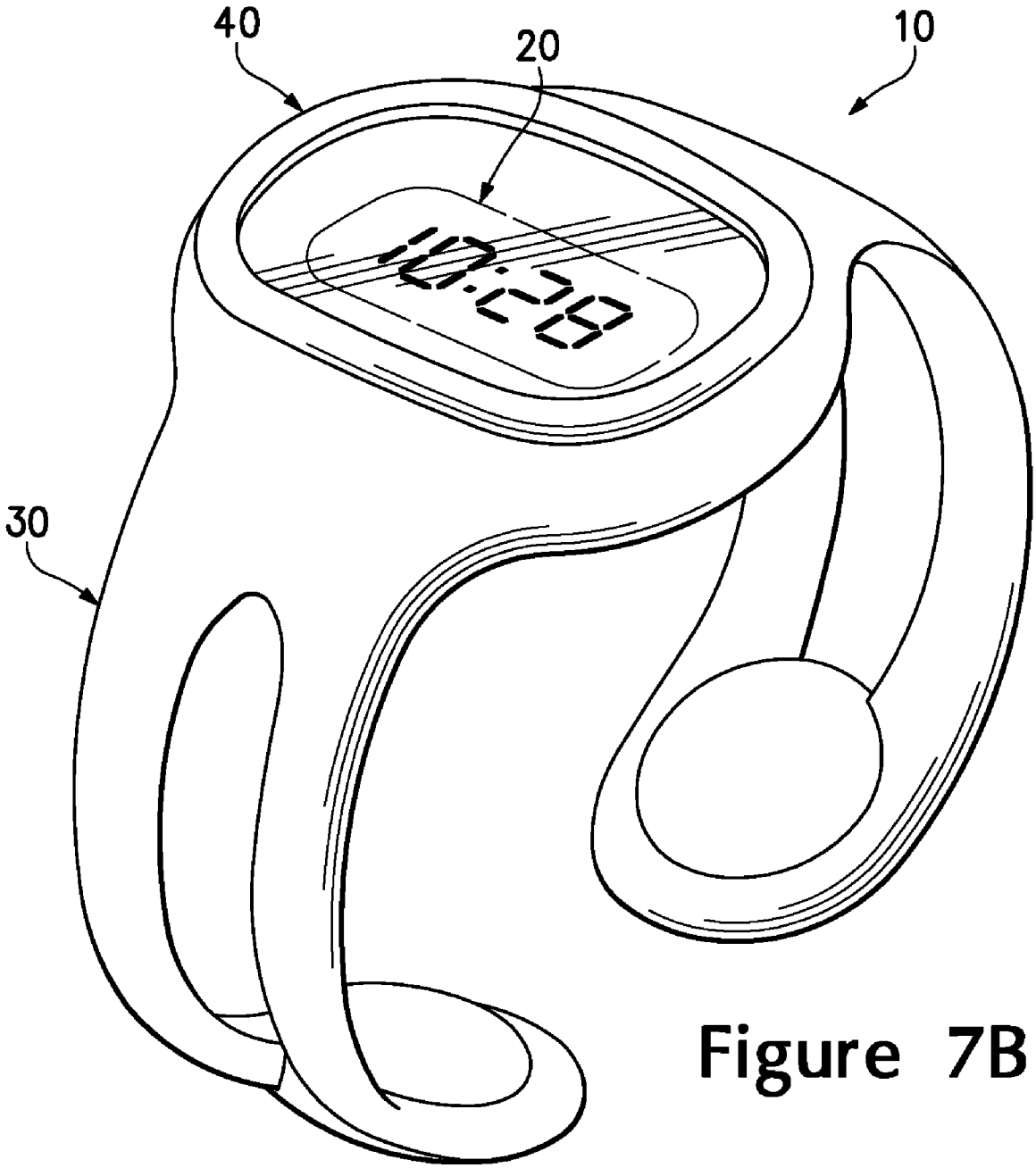
Figure 7C:
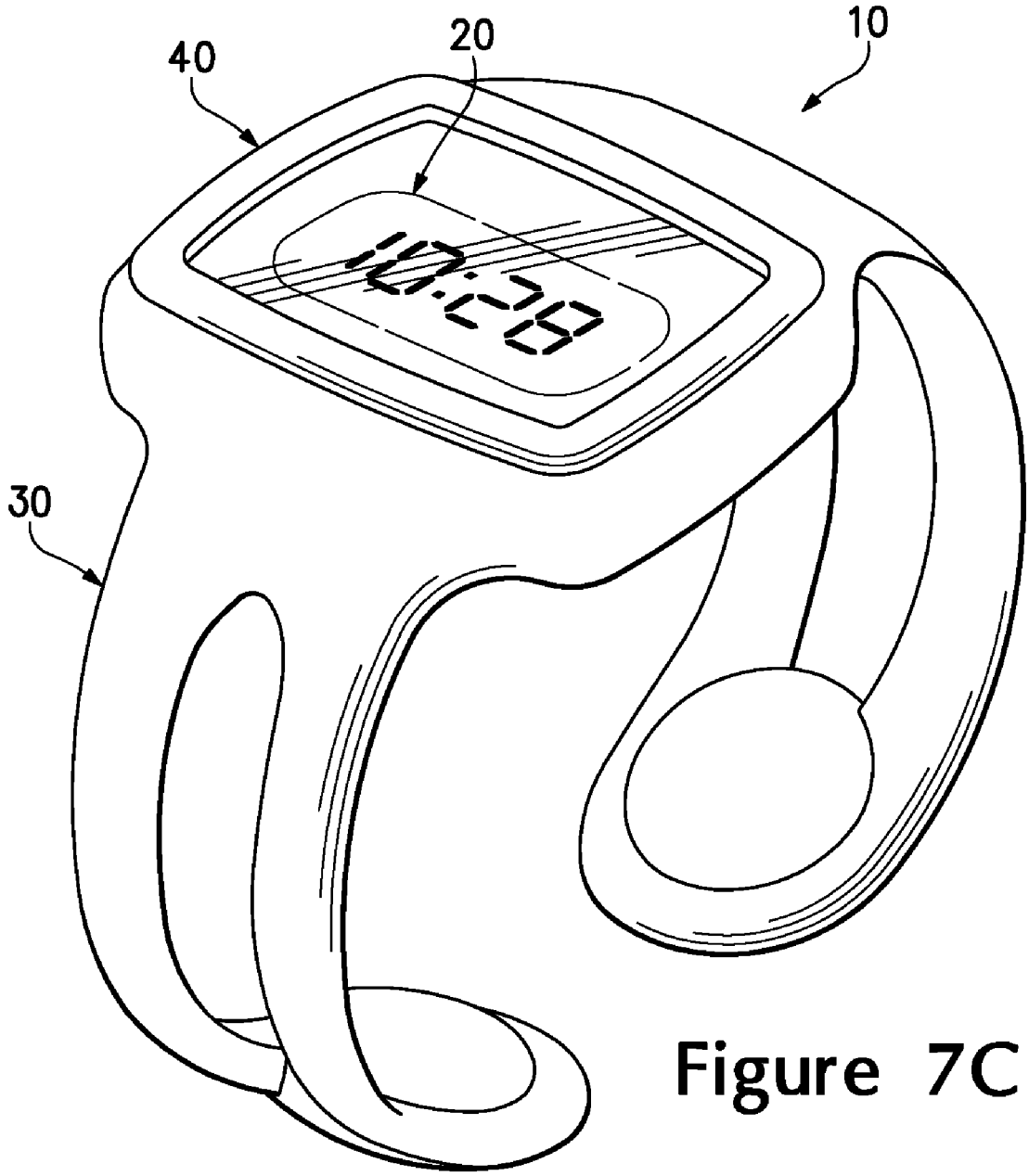
Figure 7D:
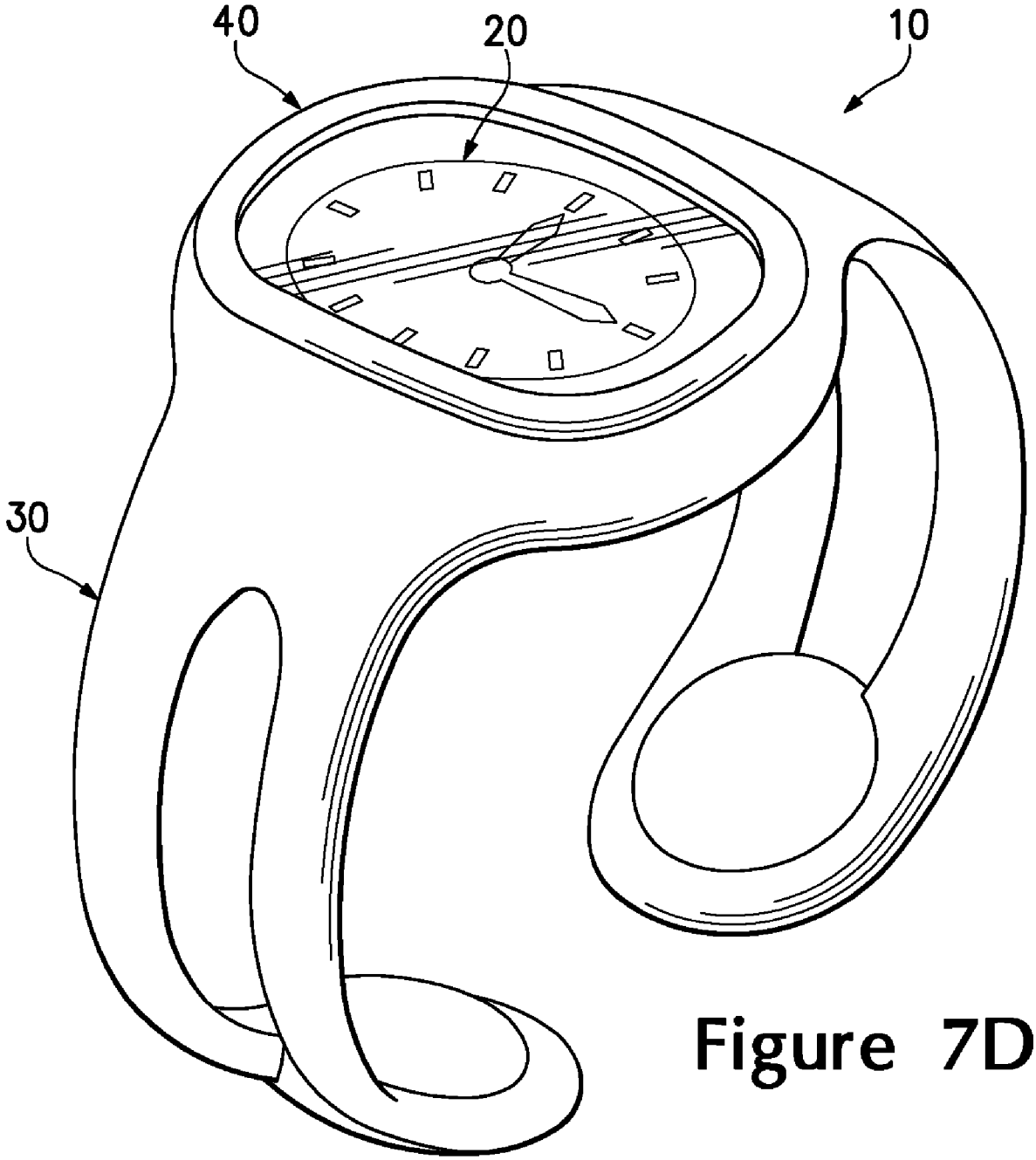
Figure 8A:
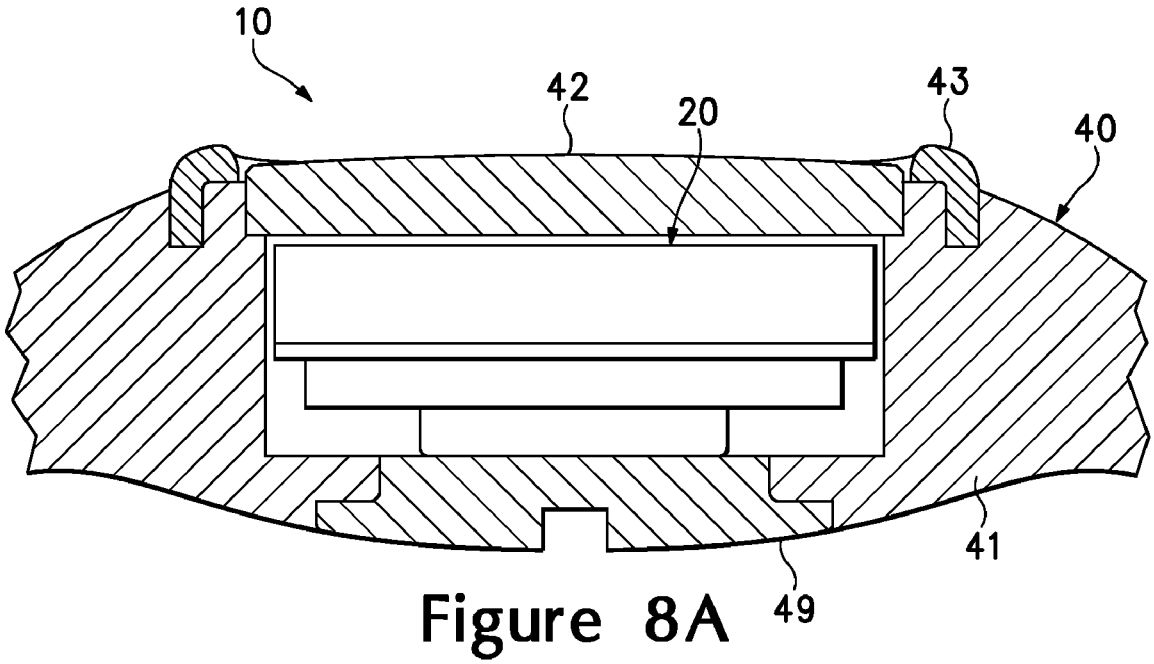
FIGS. 8A-8C are cross-sectional views corresponding with FIG. 4A and depicting additional configurations of the timepiece.
Figure 8B:
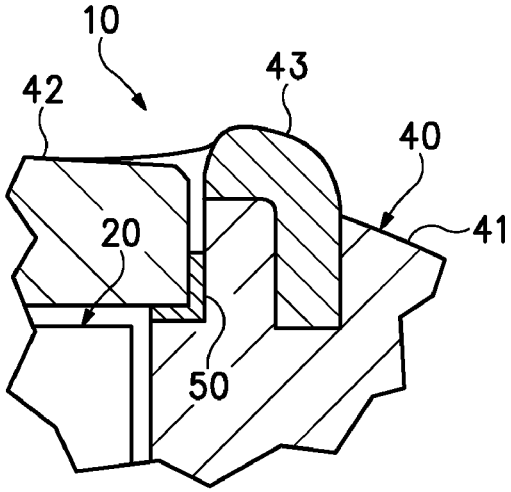
Figure 8C:
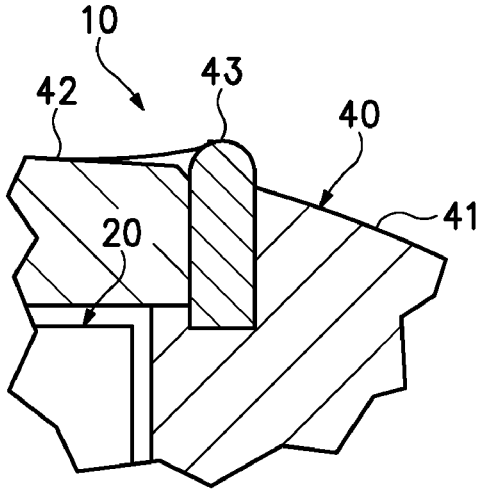

The configuration of timepiece 10 discussed above and depicted in FIGS. 1-5 provides an example of one suitable configuration. Timepiece 10 may, however, have a variety of other configurations. For example, wristband 30 may have a more traditional configuration that includes a clasp, as depicted in FIG. 7A. Timing element 20 may also have a configuration wherein buttons 22 are absent, as depicted in FIG. 7B. The shape of case 40 may also vary to include a square aspect, as depicted in FIG. 7C, but may have any of the general shapes discussed above. Timing element 20 may also display time in an analog format, as depicted in FIG. 7D. In order to change a battery of timing element 20 or make other repairs, case 40 may include a panel 49 that is positioned opposite crystal 42, as depicted in FIG. 8A. By removing panel 49, the wearer or an individual skilled in watch repair may access timing element 20. In some configurations, an insert 50 may be located between crystal 42 and portion 48, as depicted in FIG. 8B. Insert 50, which may be formed from nylon, for example, may assist with securing crystal 42 within case 40 and improve the water-resistance of timepiece 10. Although insert 50 is depicted as having an L-shaped configuration, insert 50 may also have a I-shaped or otherwise straight configuration, as depicted in FIG. 8C. In addition, crystal 42 may contact side areas of bezel 43. Accordingly, timepiece 10 may have a variety of configurations wherein bezel 43 provides stability to case 40.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method for manufacturing a wrist-worn timepiece, the method comprising:

defining a depression and a channel in a case formed from a polymer material, the depression and the channel extending inward from a common surface of the case, and the depression and the channel being spaced inward from sides of the case and from each other, the channel being located between the depression and the sides of the case;

placing a timing element within the depression;

positioning a metal bezel within the channel and around the depression, the bezel defining an aperture; and locating a crystal within the depression, through the aperture of the bezel, and adjacent to the timing element after the step of positioning the bezel within the channel.

2. The method recited in claim 1, wherein the step of defining includes locating the channel to extend entirely around the depression.

3. The method recited in claim 1, wherein the step of defining further includes spacing the channel from the depression.

4. The method recited in claim 1, wherein the step of defining includes forming the depression to have greater depth than the channel.

5. The method recited in claim 1, wherein the step of positioning includes forming the metal bezel to have an L-shaped cross-section defined by a first segment and a second segment, and the step of positioning further includes positioning the first segment in the channel and positioning the second segment to extend toward the depression.

6. The method recited in claim 1, further including a step of selecting an elastic modulus of a material of the metal bezel to be at least 40 times an elastic modulus of a material of the crystal.

7. The method recited in claim 1, further including a step of selecting an elastic modulus of a material of the metal bezel to be at least 12 times an elastic modulus of a material of the crystal.

8. The method recited in claim 1, further including a step of forming a wristband of the timepiece to be of unitary construction with the case.

* * * * *